US005103787A

United States Patent [19]

Bassler et al.

[11] Patent Number: 5,103,787

[45] Date of Patent: Apr. 14, 1992

[54] APPARATUS HAVING A POSITION ACTUATOR

[75] Inventors: Helmut Bassler, Weinstadt; Heinz Ehrentraut, Stuttgart; Friedrich Haerterich, Gerlingen, all of Fed. Rep. of Germany; Helmut Bassler, Weinstadt; Heinz Ehrentraut, Stuttgart, all of Fed. Rep. of Germany

[73] Assignee: Robert Bosch GmbH, Stuttgart, Fed. Rep. of Germany

[21] Appl. No.: 683,055

[22] Filed: Feb. 27, 1991

[30] Foreign Application Priority Data

Mar. 1, 1990 [DE] Fed. Rep. of Germany ..... 4006419

[51] Int. Cl.[5] ..... F02D 7/00

[52] U.S. Cl. ..... 123/399

[58] Field of Search ..... 123/399, 400, 361, 396, 123/342, 363; 74/513; 364/431.07; 180/197

[56] References Cited

U.S. PATENT DOCUMENTS

| | | | |
|---|---|---|---|
| 4,655,780 | 4/1987 | Bauer et al. | 123/361 |
| 4,668,440 | 5/1987 | Sausner | 123/337 |
| 4,860,708 | 8/1989 | Yamaguchi et al. | 123/399 |
| 4,879,657 | 11/1989 | Tamura et al. | 364/431.07 |
| 4,883,037 | 11/1989 | Mabee et al. | 123/399 |
| 4,896,640 | 1/1990 | Pfalzgraf et al. | 123/399 |
| 4,919,097 | 4/1990 | Mitui et al. | 123/399 |
| 4,938,304 | 7/1990 | Yamaguchi et al. | 180/197 |
| 4,944,269 | 7/1990 | Imoehl | 123/399 |
| 4,961,355 | 10/1990 | Irino et al. | 74/513 |
| 4,969,437 | 11/1990 | Kolb | 123/399 |
| 4,982,711 | 1/1991 | Gmelin | 123/399 |

FOREIGN PATENT DOCUMENTS

| | | | |
|---|---|---|---|
| 3630088 | 3/1988 | Fed. Rep. of Germany | 123/399 |
| 3639945 | 6/1988 | Fed. Rep. of Germany | 123/399 |
| 3815735 | 11/1989 | Fed. Rep. of Germany | 123/399 |

*Primary Examiner*—Raymond A. Nelli

*Attorney, Agent, or Firm*—Edwin E. Greigg; Ronald E. Greigg

[57] ABSTRACT

A positioning apparatus including a positioner, a restoring suspension means, a servo drive and an actuator, the position of which determines the power of a driving engine. The restoring suspension means assures that the actuator is always in a precisely definable position regardless of any other spring. The restoring suspension means may include a plurality of integrally cohering restoring springs. Satisfactory operation of the apparatus is assured even if one of the restoring springs should fail. The servo drive is embodied such that in the event of an electrical defect the engine operates at an intended speed (rpm). The apparatus is particularly suitable for motor vehicles in which the engine rpm is to be regulated precisely in idling via a throttle valve.

25 Claims, 3 Drawing Sheets

2
4
6
10
11
12
14
15
16
17
18
20
22
24
26
28
30
32
34
35
36
40
41
42
43
50
52
54
56
60
62
64
66
68
70
72
74
76
78
79
80
81
82
83
84
85
86
88

APPARATUS HAVING A POSITION ACTUATOR

BACKGROUND OF THE INVENTION

The invention is based on an apparatus having a position actuator, the position of which determines a power of a driving engine, as defined hereinafter.

In a known apparatus in a vehicle, a positioner can be actuated via an accelerator pedal. When the accelerator pedal is not actuated, the positioner rests on a stop. If the accelerator pedal is actuated in the full-load direction, then via the positioner, the throttle valve is likewise adjusted in the full-load direction, after a play between the positioner and a rotary element connected to the throttle valve has been overcome. An arm is also connected to the throttle valve, and a compression spring is disposed between the arm and the positioner. At one end the compression spring presses upon the positioner in the full-load direction, and on the other end it presses upon the arm in the idling direction of the engine. A tension spring acts on the positioner in the direction of reduced engine power. If the accelerator pedal is not actuated or is actuated only a little, the arm rests on a stop of a servo drive. Via the servo drive, the arm and thus the throttle valve can be adjusted in the idling range of the driving engine.

In order that the positioner will not also be adjusted by the servo drive upon the adjustment of the throttle valve, the tension spring must be substantially stronger than the compression spring between the arm and the positioner.

In the event of failure of the compression spring between the positioner and the arm connected to the throttle valve, the throttle valve will assume a floating, indeterminate position, even if the tension spring continues to work properly.

If the servo drive fails in the idling control range of the driving engine, for instance because of an electrical defect, the stop remains in the last position predetermined by the servo drive. In that case the throttle valve can be unpredictably open or widely closed with the accelerator pedal in its nonactuated position, and the driving engine can operate unforeseeably at particularly high rpm, or stall because the throttle valve is open too far, while the accelerator pedal is not actuated.

Since the compression spring is installed between the positioner and the arm, the force to be brought to bear via the servo drive to regulate the idling rpm is dependent on the position of the positioner, as well as on other factors.

The compression spring between the arm and the positioner has the result that the arm connected to the throttle valve and the positioner connected to the accelerator pedal cannot be mounted together in separate component units in a simple manner.

OBJECT AND SUMMARY OF THE INVENTION

The apparatus according to the invention has an advantage over the prior art that it is especially highly reliable in function, and that the apparatus is simple to mount.

At least two restoring springs of the restoring suspension means advantageously increase considerably the reliability of the apparatus function.

If at least two restoring springs of the restoring suspension means are made from one piece of material, this advantageously makes manufacture of the apparatus much simpler.

Actuating the drive lever in the direction of the position of repose as the driving force of the servo motor decreases has an advantage that if there is a defect while the operating element is unactuated, the actuator assumes a preselectable position.

The displaceable repose stop has the advantage that the actuator, with the aid of the servo motor, can be adjusted past the position of repose in the direction of reduced power of the driving engine due to a slack.

The slack has the advantage that upon adjustment of the actuator with the aid of the servo drive, the operating element is not actuated along with it, and that a transmission element between the operating element and the positioner always remains under tension.

The invention will be better understood and further objects and advantages thereof will become more apparent from the ensuing detailed description of a preferred embodiment taken in conjunction with the drawings.

DESCRIPTION OF THE PREFERRED EMBODIMENT

The layout and mode of operation of an apparatus according to the invention in an engine particularly in a vehicle, having an actuator the position of which determines the power of a driving engine will now be described in detail.

The apparatus according to the invention can be used with any engine in which the power of the driving engine is to be controlled. The term "driving engine" may be understood to be either a stationary engine, or a self-propelled machine, i.e., a vehicle. Although not limited solely to this, the description of the exemplary embodiment will assume for the sake of simplicity that the apparatus according to the invention is installed in a vehicle in which the driving engine is an internal combustion engine with externally supplied ignition.

Figure 1:
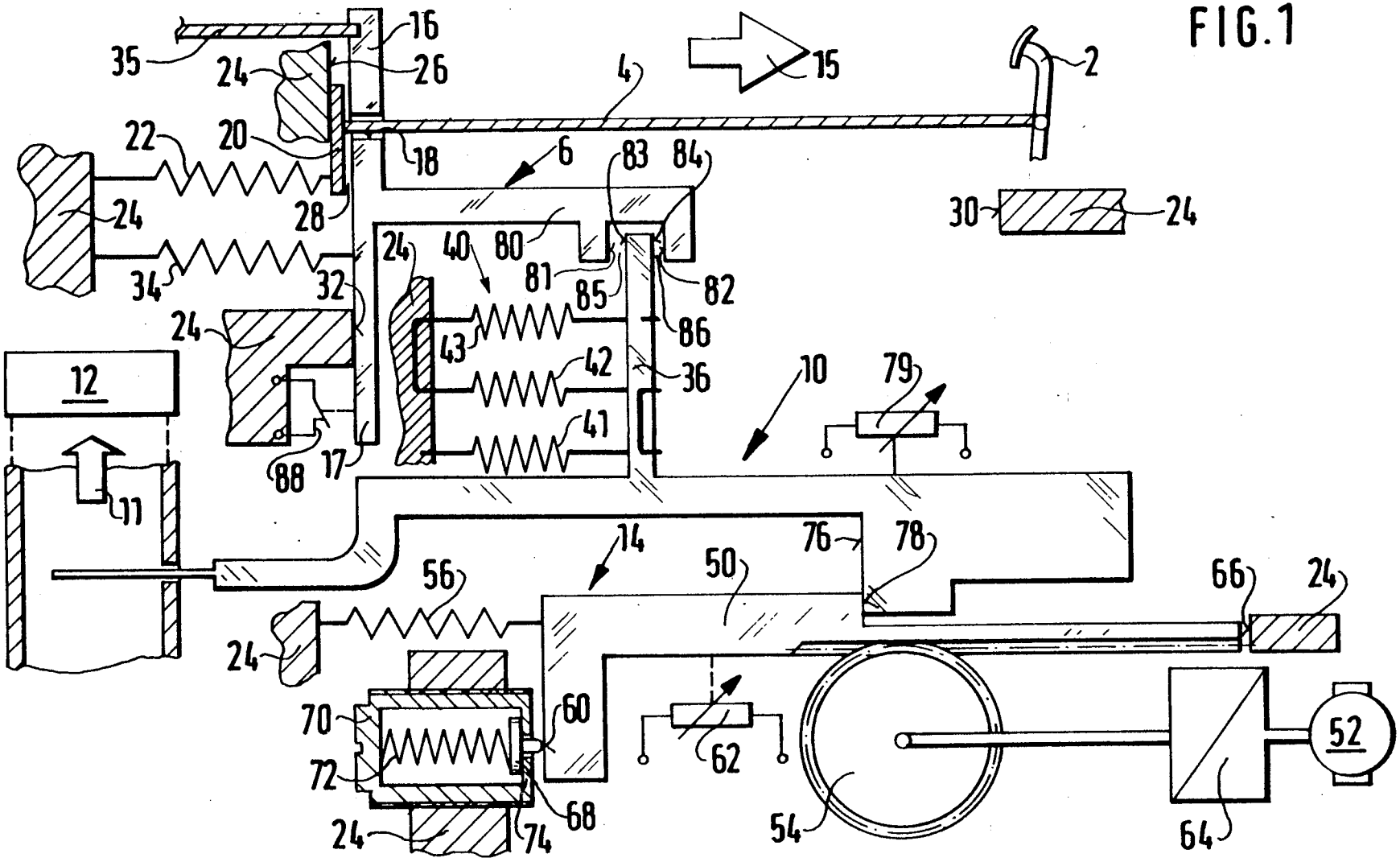
FIG. 1 shows the exemplary embodiment of an apparatus embodied in accordance with the invention.

FIG. 1 shows the exemplary embodiment in linearized form. The apparatus substantially includes an operating element 2, a transmission element 4, a positioner 6, an actuator 10, a driving engine 12 and a servo drive 14. Via the actuator 10, the size of a free intake cross section is determined. Thus, with the aid of the actuator 10, a flow aspirated by the engine 12 can be varied. In the drawing, this flow is indicated by an arrow 11 pointing in the direction of the engine 12.

The drawing also shows an arrow 15. The direction of motion of the transmission element 4, the positioner 6 in the actuator 10 is parallel to the arrow 15 and transmission element 4. Actuation of the actuator 10 in the direction of the arrow 15 represents an increase in power of the engine 12; the opposite direction represents a decrease in power.

An outer pivot lever 16 and an inner lever 17 are formed onto the positioner 6. A recess 18 extends parallel to the arrow 15 through the outer pivot lever 16 of the positioner 6. The transition element 4 extends through an aperture 18 of the positioner 6. The end of the transmission element 4 pointing in the direction of the arrow 15 is connected to the operating element 2. On the side of the outer pivot lever 16 of the positioner 6 remote from the operating element 2, a thickened end portion 20 is formed onto the transmission element 4. The thickened end portion 20 of the transmission element 4, because of its size and shape, does not fit through the recess 18 of the positioner 6.

An operating element restoring spring 22 acts at one end on a base 24 and at the other on the thickened portion 20 of the transmission element 4. The base 24 is a part that is immovable with respect to the apparatus, such as a frame of the vehicle or a housing of the apparatus. The operating element restoring spring 22 acts upon the thickened end portion 20 and thus on the transmission element 4 and upon the operating element 2 counter to the arrow 15, urging the thickened portion 20 of the transmission element 4 toward a fixed stop 26. The stop 26 is provided on the base 24.

Upon actuation of the operating element 2 in the direction of the arrow 15, the thickened end portion 20 of the transmission element 4 comes into contact, after overcoming a spacing 28 between the thickened portion 20 and the outer pivot lever 16 of the positioner 6. Upon further actuation of the operating element 2 in the direction of the arrow 15, the positioner 6 is actuated together with the operating element 2 in the direction of the arrow 15. The mobility of the positioner 6 in the direction of the arrow 15 is limited by the fact that one end of the positioner 6 comes to rest on a right-hand fixed stop 30. Counter to the arrow 15, the mobility of the positioner 6 is limited by a fixed stop 32 on the left, on which the inner lever 17 of the positioner 6 can come to rest. A positioner restoring spring 34 acts at one end on a portion of the base 24 and at the other on the positioner 6 counter to the arrow 15.

Depending on the type of use of the apparatus, the outer pivot lever 16 of the positioner 6 is connected to a further transmission element 35. Then action can be exerted upon other components, not shown, by the apparatus, or these components not shown can act upon the actuator 10.

The transmission element 4 in its normal position is advantageously spaced from positioner 6 via a kind of slack or space 28. The slack results from the cooperation among the thickness end portion 20, the aperture 18, and the transmission element 4, which is passed through the aperture 18. The slack may be suitable for compensating for tolerances, particularly in the region of the transmission element 4. However, it is also possible to pivotably attach the transmission element 4 firmly to the positioner 6, as is the case for instance between the further transmission element 35 and the positioner 6.

A lever 36 is formed onto the actuator 10 and extends upwardly toward the positioner 6. In the apparatus according to the invention, a restoring suspension means 40 is provided. The restoring suspension means acts inventively on a portion of the base 24 on the one hand and on the lever 36 and thus on the actuator 10 on the other. The restoring suspension means 40 acts upon the actuator 10 counter to the direction of the arrow 15. The restoring suspension means includes at least one first restoring spring 41. In the preferred embodiment of the apparatus according to the invention shown in FIG. 1, the restoring suspension means 40 also includes a second restoring spring 42 and a third restoring spring 43. The three restoring springs 41, 42, 43 are manufactured coheringly from an uninterrupted starting material, in the exemplary embodiment shown. In other words, the restoring suspension means 40 preferably comprises either two integrally cohering restoring springs 41, 42 or three or more, embodied as three integrally cohering restoring spring 41, 42, 43, but it may also comprise two or more separate restoring springs 41, 42, 43.

The servo drive 14 includes a control lever 50, a servo motor 52, a pinion 54, a restoring spring 56, a repose stop 60, a movable control-lever actual-value transducer 62, and optionally also a gear 64 between the servo motor 52 and the pinion 54. The servo motor 52 is typically an electric motor, but it may also be a hydraulic motor, for instance.

The control lever 50 is likewise adjustable parallel to the direction of the arrow 15. Given adequate displacement of the control lever 50 in the direction of the arrow 15, the control lever 50 can come to rest on a fixed stop 66 provided on a portion of the base 24. The restoring spring 56 acts at one end upon a portion of the base 24 and at the other upon the control lever 50. The restoring spring 56 acts counter to the direction of the arrow 15 upon the control lever 50. The servo motor 52 can actuate the control lever 50 in the direction of the arrow 15 counter to the restoring spring 56, until one end of the control lever 50 rests on the stop 66. In this process the control lever 50 lifts away from the movable stop 60. If the control lever 50 has lifted from the repose stop 60, then upon shutoff of the servo motor 52 or if the driving power of the servo motor 52 is reduced, the restoring spring 50 can actuate the control lever 50 counter to the direction of the arrow 15, until the control lever 50 comes to rest on the movable stop 60.

The movable stop 60 is provided in an end, pointing in the direction of the arrow 15, of a stepped bolt 68. The thicker portion of the stepped bolt 68 is located inside a hollow set screw 70. The thicker portion of the bolt 68 is actuated counter to an end wall 74 of the set screw 70 by a prestressed spring 72 disposed inside the set screw 70, so that only the thinner part of the bolt 68 protrudes outward somewhat through an opening in the end wall 74 of the set screw 70 in the direction of the arrow 15. The set screw 70 has an external thread and is thus screwed into an internal thread portion of the base 24. By rotating the set screw 70, the movable stop 60 that develops on the bolt 68 can be adjusted parallel to the direction of the arrow 15. The apparatus may also be embodied such that the movable stop 60 and the end wall 74 are adjustable independently of one another.

Via the servo motor 52, the control lever 50 can also be adjusted counter to the direction of arrow 15. Upon adjustment of the control lever 50 counter to the direction of the arrow 15, the control lever 50 first comes to rest on the repose stop 60. If the control lever 50 is actuated farther counter to the direction of the arrow 15 beyond this point, then the control lever 50 presses the bolt 68 and the movable stop 60 contrary to the direction of the arrow 15, counter to the force of the prestressed spring 72. In the exemplary embodiment shown, the servo motor 52 can actuate the control lever 50 counter to the direction of the arrow 15 until the control lever 50 comes to rest on the end wall 74 of the set screw 70. Once the servo motor 52 actuates the control lever 50 counter to the direction of the arrow 15, so that the thicker part of the bolt 68 has lifted away from the end wall 74 of the set screw 70, and in this position of the control lever 50 if the servo motor 52 is switched off or the drive power of the servo motor 52 is lowered sufficiently, then the prestressed spring 72 can adjust the control lever 50 in the direction of the arrow 15, until the thicker part of the bolt 68 rests on the end wall 74 of the set screw 70. To this end, the prestressed spring 72 is stronger than the sum of the forces of the restoring spring 56 and the restoring suspension means 40. Since only a short distance needs to be damped with the prestressed spring 72, adequate dimensioning of the prestressed spring 72 is no problem.

An actuator stop 76 is provided on the actuator 10. The control lever 50 of the servo drive 14 includes a control stop 78. If the control lever 50 moves in the direction of the arrow 15 and/or the actuator 10 moves counter to the direction of the arrow 15, then the control stop 78 can come to rest on the actuator stop 76. If the actuator stop 76 is resting on the control stop 78 and the control lever 50 is actuated in the direction of the arrow 15, then the actuator 10 is carried along accordingly. If the control lever 50 is moved counter to the direction of the arrow 15, then the restoring suspension means 40 adjusts the actuator 10, with the operating element 2 unactuated, likewise counter to the direction of the arrow 15 in accordance with the motion of the control lever 50.

A displacement of the actuator 10 by the servo drive 14, in other words via the control lever 50 with the aid of the servo motor 52, can occur only within the range until the control lever 50 comes into contact either with the stop 66 of a portion of the base 24 or with the end wall 74 of the set screw 70. This range in which the actuator 10 can be adjusted with the aid of the servo drive 14 is equivalent to the idling control range of the driving engine 12. When the engine 12 is cold, the control lever 50 tends to be moved more toward the stop 66 of the portion of the base 24, while when the engine 12 is at a proper operating temperature the control lever 50 tends to be moved more toward the end wall 74 of the set screw 70 with the aid of the servo motor 52. The servo drive 14 is designed such that very fine adjustability of the idling rpm of the engine 12 is possible. Because of the stop 66 it is impossible for the actuator 10 to be actuated too far in the direction of the arrow 15 via the servo drive 14, so that even if the servo drive 14 is not operating properly, excessively high, unwanted power of the engine 12 is not possible. The stop 66 is an advantageous mechanical means of protection in addition to an electrical protection by a fuse for the servo drive 14.

When the operating element 2 is not actuated, the position of the actuator 10 is determined by the position of the control lever 50. The restoring suspension means 40, the restoring spring 56 and the prestressed spring 72 are matched to one another in such a way that in the event of failure of the servo motor 52 or with the servo motor 52 not triggered, the thicker part of the bolt 68 rests on the end wall 74 of the set screw 70. Thus via the set screw 70, the position of the movable stop 60 on which the control lever 50 rests in the event of failure of the servo motor 52 can be preset as needed. It is particularly suitable to select the position of the movable stop 60 such that even in the event of failure of the servo motor 52 the engine 12 reliably continues to operate in the idling range.

The position of the control lever 50 can be actuated by a control-lever actual-value transducer 62. The position of the actuator 10 can be actuated by an actuator actual-value transducer 79. With the aid of the control-lever actual-value transducer 62 and the actuator actual-value transducer 79, idling control of the engine 12 can be improved markedly.

An inner pivot lever 80 with a first lever stop 81 and a second lever stop 82 is provided on the positioner 6. The lever 36 of the actuator 10 has a third lever stop 83 and a fourth lever stop 84. The four lever stops 81, 82, 83, 84 are disposed as follows: If the positioner 6 moves in the direction of the arrow 15 and/or if the actuator 10 moves counter to the direction of the arrow 15, then the third lever stop 83 of the lever 36 of the actuator 10 can come to rest on the first lever stop 81. If the positioner 6 is moved counter to the direction of the arrow 15 and/or the actuator 10 moves in the direction of the arrow 15, the fourth lever stop 84 of the actuator 10 can optionally come to rest on the second lever stop 82 of the positioner 6. Extending between the first lever stop 81 of the positioner 6 and the third lever stop 83 of the lever 36 of the actuator 10 is a first variably large clearance 85, and a more or less large second clearance 86 extends between the second lever stop 82 and the fourth lever stop 84 of the lever 86.

When the operating element 2 is not actuated, the positioner 6 rests on the left stop 32 of a portion of the base 24. An idling switch 88 is disposed on the base 24. The idling switch 88 indirectly signals the actuation state of the operating element 2. When the operating element 2 is not actuated, the actuator stop 76 rests on the control stop 78 of the servo drive 14, and the position of the actuator 10 results from the position of the control lever 50; that is, the position of the actuator 10 is determined via the servo drive 14. The first clearance 85 and the second clearance 86 should be dimensioned in such a way that when the operating element 2 is not actuated, upon adjustment of the actuator 10 via the servo drive 14, the lever 36 of the actuator 10 does not come to rest on the lever stops 81, 82; in other words, with the operating element 2 unactuated, the actuator 10 is freely movable relative to the positioner 6 and thus also relative to the operating element 2, for the sake of regulating the idling rpm of the engine 12.

Upon actuation of the operating element 2 in the direction of the arrow 15, the thickened portion 20 of the transmission element 4 first comes to rest on the outer pivot lever 16 of the positioner 6. If the operating element 2 is actuated beyond this in the direction of the arrow 15, then the positioner 6 lifts away from the left stop 32 of the base 24, and after overcoming the first clearance 85 the first lever stop 81 can come to rest on the third lever stop 83 of the actuator 10. If the operating element 2 is actuated farther than this in the direction of the arrow 15, then the actuator 10 is also adjusted in the direction of the arrow 15, and the actuator stop 76 lifts away from the control stop 78 of the servo drive 14. The position of the actuator 10 is now solely determined by the position of the operating element 2. The actuator 10 can be adjusted via the operating element 2 in the direction of the arrow 15 until the positioner 6 comes to rest on the right stop 30 of a portion of the base 24. The possible adjustment range of the actuator 10 via the operating element 2 is a multiple of the possible adjustment range of the actuator 10 via the servo drive 14. If the positioner 6 is adjusted as far as the vicinity of the right-hand stop 30 and the operating element 2 is then released, then the operating element restoring spring 22 assures restoration of the operating element 2 and of the transmission element 4, until the thickened portion 20 comes to rest on the stop 26 of the base 24. The positioner restoring spring 34 now likewise adjusts the positioner 6 counter to the direction of the arrow 15, until the positioner 6 rests on the left-hand stop 32. At the same time, the restoring suspension means 40 adjusts the actuator 10 counter to the direction of the arrow 15, until the actuator 10, with the actuator stop 76, comes to rest on the control stop 78 of the servo drive 14. Via the lever stop 82, the positioner restoring spring 34 can reinforce a return of the actuator 10, when the operating element 2 is released. Given adequate dimensioning of the restoring suspension means 40, the second lever stop 82 on the positioner 6 and the fourth lever stop 84 of the actuator 10 are not absolutely necessary and can be omitted.

Via the restoring suspension means 40, an exact position of the actuator 10 in all conceivable operating states is assured. It is particularly advantageous to dimension the restoring suspension means 40 such that even if the operating element restoring spring 22 and/or the positioner restoring spring 34 and/or the restoring spring 56 should fail, the actuator 10 is, when the operating element 2 is not actuated, moved counter to the direction of the arrow 15 until the actuator 10 rests on the servo drive 14, so that under all circumstances the actuator is prevented from unintentionally remaining where it is as well as from unintended motion in the direction of the arrow 15, and hence into the region of higher power of the driving engine 12. In other words, in the apparatus according to the invention having the restoring suspension means 40 it can be assured that even if the operating element restoring spring 22 and/or the positioner restoring spring 34 and/or the restoring spring 56 should fail, the actuator 10 is retrieved into a precisely defined, preselectable position equivalent to idling rpm of the engine 12, whenever the operating element 2 is not actuated. Thus the apparatus according to the invention remains at least operationally reliable, given suitable dimensioning of the restoring suspension means 40, even if the positioner restoring spring 34, the operating element restoring spring 22 and/or the restoring spring 56 should fail or be missing.

Particular advantages result if the restoring suspension means 40 comprises more than one spring. For instance if it comprises two restoring springs, in other words the first restoring spring 41 and the second restoring spring 42, and if each of the two restoring springs 41, 42 are dimensioned such that each of these restoring springs 41, 42 can by itself provide for the restoration of the actuator 10, then reliable restoration of the actuator 10 is assured even if one of the two restoring spring 41, 42 fails. If the restoring suspension means 40 comprises two restoring springs 41, 42, then each of the restoring springs 41, 42 must suitable be capable of bringing to bear the necessary restoring force. In other words, the restoring suspension means 40 is advantageously embodied twice as strong as would intrinsically be necessary. However, if the restoring suspension means 40 comprises three restoring springs 41, 42, 43, or even more restoring springs, then advantageously the restoring suspension means 40 need not be as strong to provide the same safety. For instance, if the restoring suspension means comprises the three restoring springs 41, 42, 43 and if one of the restoring springs 41, 42, 43 fails, then satisfactory restoration of the actuator 10 occurs as long as the two remaining restoring springs together can bring to bear the necessary restoring force. In other words, with three restoring springs 41, 42, 43 the total restoring force of the restoring suspension means 40 is 1.5 times as high as intrinsically necessary. With more than three restoring springs, the overdimensioning of the restoring suspension means 40 can be even less; nevertheless, in the event of failure of one of the restoring springs 41, 42, 43 the restoration of the actuator 10 counter to the direction of the arrow 15 is still assured.

For the sake of simple assembly, at least two of the restoring springs 41, 42, 43 may be embodied as integrally cohering restoring springs 41, 42, 43. However, all the restoring springs 41, 42, 43 of the restoring suspension means 40 may also be embodied as one integrally cohering component. The restoring springs 41, 42, 43 made in one piece may be applied to the base 24 or to the lever 36 of the actuator 10 in such a way that regardless of the position of a possible break within the unit comprising the restoring springs 41, 42, 43, at most one of the restoring springs 41, 42, 43 will fail. If a plurality of restoring springs 41, 42, 43 of the restoring suspension means 40 are embodied integrally, the result is particularly simple assembly of the restoring suspension means 40.

The apparatus according to the invention has been described in terms of an exemplary embodiment in which the positioner 6, the actuator 10 and the control lever 50 of the servo drive 14 can execute rectilinear motions parallel to the direction of the arrow 15. It is equally possible, and even more favorable in many applications, to support the components described here such that they are rotatable on pivot shafts; it is particularly suitable if all the shafts are aligned in the same line. The positioner 6, the actuator 10 and the control lever 50 then do not execute reciprocating motions parallel to the arrow 15 but instead make more or less wide swiveling motions about the pivot shaft. An adjusting motion in the direction of the arrow 15 then for instance represents a swiveling motion in one rotational direction, and counter to the arrow 15 represents a swiveling motion in the opposite direction. All the components may be embodied such that they are more or less round or curved.

The apparatus according to the invention has still other considerable advantages in terms of assembly options, as will now be explained in greater detail referring to FIGS. 2 and 3. In all the drawing figures, elements that are the same or function the same are identified by the same reference numerals.

Figure 2:
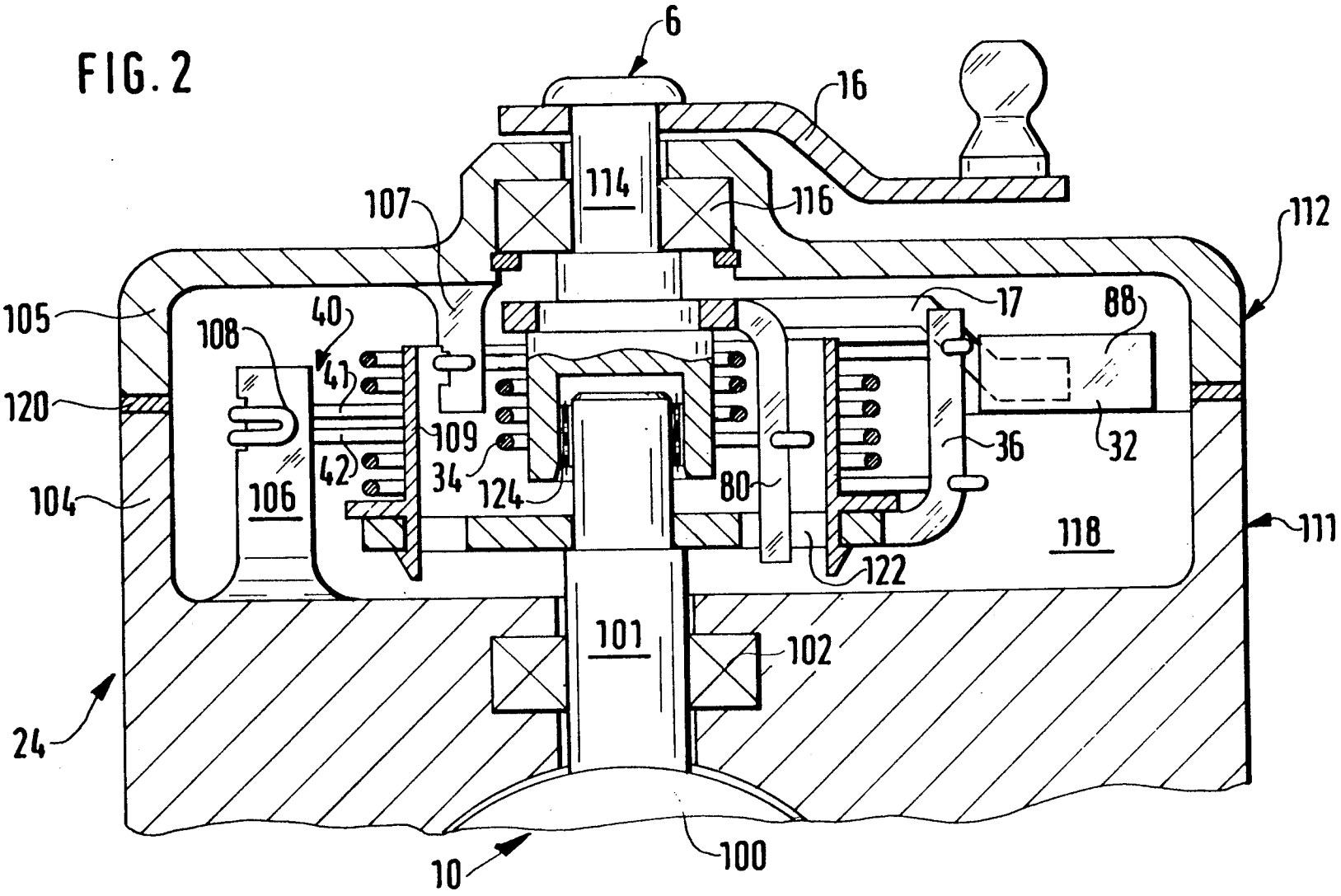
FIGS. 2 and 3 show details of the apparatus according to the invention and a preferred spatial arrangement of the components of the apparatus.

FIG. 2 is a detail showing a special application of the apparatus according to the invention. Here the positioner 6 and the actuator 10 are rotatably supported about shafts that are in alignment with one another. The actuator 10 for instance includes a throttle valve 100 and a throttle valve shaft 101. Together with the throttle valve shaft 101 the throttle valve 100 is rotatably supported with the aid of one or more bearings 102 in a throttle valve housing 104. The throttle valve shaft 101 extends in both directions past the throttle valve 100. The actuator stop 76, which can be engaged by the servo drive 14, is provided on one end of the throttle valve shaft 101 of the actuator 10. This end of the throttle valve shaft 101 is not shown in FIG. 2 for the sake of simplicity. The servo drive 14 is not shown either, again for the sake of simplicity.

In FIG. 2, the base or housing 24 includes the throttle valve housing 104 and a cap 105. An upright holder 106 is formed onto the throttle valve housing 104 in axial alignment with shaft 101. A further holder 107 is connected to the cap 105 and extends downwardly. The lever 36 is firmly connected to the throttle valve shaft 101. Thus the lever 36 is a component of the actuator 10, as also shown in FIG. 1.

In the exemplary embodiment shown in FIG. 2 the restoring suspension means 40 comprises the two restoring springs 41, 42. The two restoring springs 41, 42 are wound from a single cohering piece of spring wire. The restoring springs 41, 42 are each suspended by one end on the lever 36. The other two ends of each of the two restoring springs 41, 42 are joined together via a shared curve 108. The ends of the restoring springs 41, 42, with the shared curve 108, are suspended from the holder 106 of the base 24. The restoring springs 41, 42 are pivotably attached to the base 24 and to the lever 3 of the actuator 10 in such a way that regardless of any possibly break, at least one of the restoring springs 41, 42 remains fully functional. The restoring springs 41, 42 of the restoring suspension means 40 in FIG. 2 are cylindrically wound torsion springs. For better guidance of the restoring springs 41, 42, a cylinder-like spring guide 109 is suspended from the lever 36. The restoring springs 41, 42 extend around the cylinder-like spring guide 109.

The throttle valve housing 104, the holder 106, the bearing 102, the throttle valve shaft 101, the throttle valve 100, the lever 36 and the restoring suspension means 40 are components of a first component unit 111. The cap 105, the holder 107 and the positioner 6, along with the outer pivot lever 16, the inner lever 17 and the inner pivot lever 80, as well as the positioner restoring spring 34 are all components of a second component unit 112. The two component units 111, 112 can be preassembled separately and then joined easily and simply. A particular advantage of this is that the two component units 111, 112 are not connected to one another via springs. As a result, the cap 105 can simply be seated on the throttle valve housing 104, without having to take any springs connecting the two units 111, 112 into account with one another when attaching the cap 105 to the throttle valve housing 10.

In FIG. 2, the positioner 6 comprises a rotationally symmetrical base body 114, with which the outer pivot lever 16, the inner lever 17 and the inner pivot lever 80 are firmly connected. The base body 114 of the positioner 6 is rotatably supported in the cap 105 with the aid of a bearing 116. The positioner restoring spring 34 in FIG. 2 is a cylindrically wound torsion spring, one end of which is suspended on the holder 107 of the base 24 and the other end of which is suspended on the inner pivot lever 80. Thus once again the positioner restoring spring 34, as in FIG. 1, engages the base 24 with one end and the positioner 6 with the other end.

The throttle valve housing 104 and the cap 105 are formed such that an inner chamber 118 is encompassed by these two structural parts. Thus, the components located inside the inner chamber 118, in particular the restoring suspension means 40, the idling switch 88, the positioner restoring spring 34, the bearings 102, 116, the lever 36, the inner lever 17 and the inner pivot lever 80 are all protected against external influences of the environment. Additionally, a seal 120 may be provided for sealing between the cap 105 and the throttle valve housing 104.

In FIG. 1, the lever 36 of the actuator 10 engages a bracket-like recess in the inner pivot lever 80 of the positioner 6. In the embodiment shown in FIG. 2, the same effect is attained; in this case the inner pivot lever 80 of the positioner 6 engages a recess 122 provided in the lever 36 of the actuator 10. The lever stops 83, 84 of the lever 36 of the actuator 10 are located on the rim of the recess 122, and the lever stops 81, 82 of the positioner 6 are located on the inner pivot lever 80. The lever stops 81, 82, 83, 84 are provided such that they come to rest on one another in the same way as explained for the exemplary embodiment shown in FIG. 1.

During the joining of the two component units 111, 112, the positioner 6 and the actuator 10 are in their respective positions of repose, defined by the various springs. It is assured that the first clearance 85 and the second clearance 86 are present between the first lever stop 81 and the third lever stop 83, and between the second lever stop 82 and the fourth lever stop 84, respectively. This advantageously makes joining of the second component unit 112 to the first unit 111 considerably simpler. A particular advantage is that no springs need to be introduced or suspended afterward inside the inner chamber 118, which becomes very difficult to access from outside, after the joining of the two units 111, 112. To avoid having the basic body 114 of the positioner 6 supported in an overhung fashion, the basic body 114 can be supported not only by the bearing 116 but also via a bearing 124 on the throttle valve shaft 101. The bearing 124 does not prevent joining of the two units 111, 112, yet it permits a rotatable bearing of the positioner 6 relative to the throttle valve shaft 101.

Figure 3:
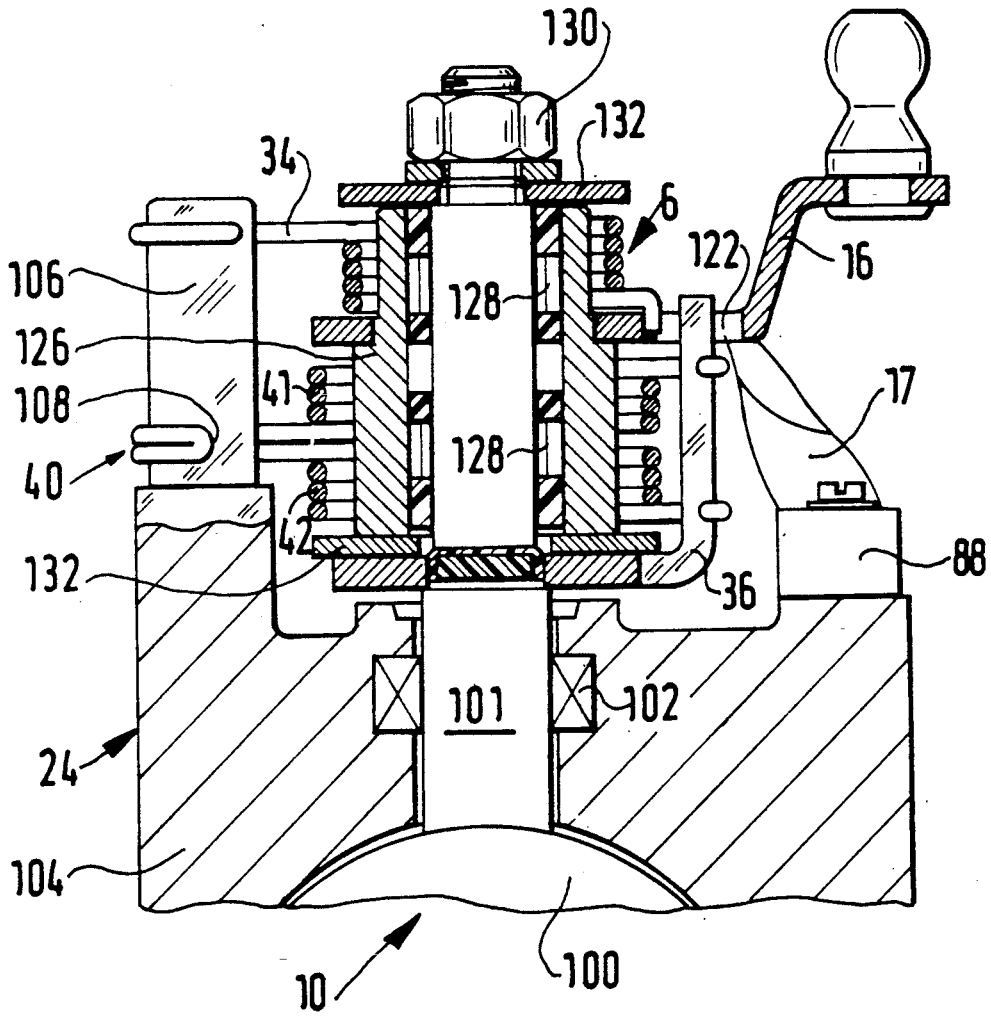

FIG. 3 shows an open embodiment of the apparatus according to the invention. In FIG. 3 as well, as in FIG. 2, only part of the apparatus according to the invention is shown for the sake of simplicity. In the exemplary embodiment shown in FIG. 3, the positioner 6 is substantially composed of the outer pivot lever 16 and a sleeve 126. The sleeve 126 of the positioner 6 is supported via two bearings 128 on the throttle valve shaft 101 such that it is rotatable relative to the throttle valve shaft 101. The throttle valve shaft 101 of the actuator 10 protrudes past the sleeve 126 of the positioner 6 on both ends. On the end of the throttle valve shaft 101 remote from the throttle valve 100, a nut 130 is connected to the throttle valve shaft 101. The nut 130, along with a washer 132, provides for axial securing of the sleeve 126 of the positioner 6 on one end. On the end of the sleeve 126 remote from the nut 130, the lever 36 of the actuator 10 is connected in a manner fixed against relative rotation to the throttle valve shaft 101 of the actuator 10. On the end of the sleeve 126 remote from the nut 130, the lever 36 assures axial securing of the sleeve 126 of the positioner 6. To reduce friction, a further washer 132 is disposed between the sleeve 126 of the positioner 6 and the lever 36 of the actuator 10. The washers 132 are advantageously of a low-wear friction-reducing material.

In FIG. 3, the recess 122 is provided in the region of the outer pivot lever 16 of the positioner 6. The recess 122 contains the lever stops 81, 82. The lever 36 of the actuator 10 engages the inside of the recess 122 of the outer pivot lever 16 of the positioner 6. The various lever stops 81, 82, 83, 84 come into contact with one another in the same way as has been explained for the first exemplary embodiment of FIG. 1. In the exemplary embodiment of FIG. 3, the positioner restoring spring 34 is a cylindrically wound torsion spring. One end of this restoring spring 34 is pivotably attached to the holder 106 of the base 24, and the other end of this spring 34 engages the outer pivot lever 16 of the positioner 6. In the embodiment shown in FIG. 3 as well, assembly is made easier by means of the clearances 85, 86 between the positioner 6 and the actuator 10.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus including an actuator (10) for adjusting a throttle valve, a position of which determines a power of an engine, an operating element (2), a transmission means (4) actuatable by said operating element, a positioner (6) actuatable by said operating element (2) via said transmission means, a first stop means upon which said positioner comes to rest in an engine decreased power direction, said positioner forming a clearance with said actuator (10) when in a rest position against said first stop means and operative by said operating element to adjust said actuator for increasing and decreasing engine power after overcoming said clearance therebetween, a servo drive (14) in operative contact with said actuator, said servo drive varies a position of said actuator in a range of low engine power in said clearance between said positioner (6) and said actuator (10), a restoring suspension means is secured at one end to a fixed base (24) and at an opposite end to said actuator (10) whereby said restoring suspension means (40) acts upon said actuator in a direction of lower engine power.

2. An apparatus as defined by claim 1, in which the restoring suspension means (40) includes at least two restoring springs (41, 42, 43).

3. An apparatus as defined by claim 1, in which the restoring suspension means (40) includes at least two integrally cohering restoring springs (41, 42, 43).

4. An apparatus as defined by claim 2, in which the restoring suspension means (40) includes at least two integrally cohering restoring spring (41, 42, 43).

5. An apparatus as defined by claim 1, in which the servo drive (14) includes a control lever (50) actuatable by a servo motor (52) and having a control stop (78), wherein the servo drive (14), via the control stop (78) and via an actuator stop (76) provided on the actuator (10), acts upon the actuator (10) in a direction of higher power of the engine (12).

6. An apparatus as defined by claim 2, in which the servo drive (14) includes a control lever (50) actuatable by a servo motor (52) and having a control stop (78), wherein the servo drive (14), via the control stop (78) and via an actuator stop (76) provided on the actuator (10), acts upon the actuator (10) in a direction of higher power of the engine (12).

7. An apparatus as defined by claim 3, in which the servo drive (14) includes a control lever (50) actuatable by a servo motor (52) and having a control stop (78), wherein the servo drive (14), via the control stop (78) and via an actuator stop (76) provided on the actuator (10), acts upon the actuator (10) in a direction of higher power of the engine (12).

8. An apparatus as defined by claim 4, in which the servo drive (14) includes a control lever (50) actuatable by a servo motor (52) and having a control stop (78), wherein the servo drive (14), via the control stop (78) and via an actuator stop (76) provided on the actuator (10), acts upon the actuator (10) in a direction of higher power of the engine (12).

9. An apparatus as defined by claim 5, in which said servo drive (14) includes a restoring spring (56) that engages the control lever (50), wherein the restoring spring (56) tends to actuate the control lever (50) in a direction of lower power of the engine (12) toward a movable stop (60) into a position of repose.

10. An apparatus as defined by claim 6, in which said servo drive (14) includes a restoring spring (56) that engages the control lever (50), wherein the restoring spring (56) tends to actuate the control lever (50) in a direction of lower power of the engine (12) toward a movable stop (60) into a position of repose.

11. An apparatus as defined by claim 7, in which said servo drive (14) includes a restoring spring (56) that engages the control lever (50), wherein the restoring spring (56) tends to actuate the control lever (50) in a direction of lower power of the engine (12) toward a movable stop (60) into a position of repose.

12. An apparatus as defined by claim 8, in which said servo drive (14) includes a restoring spring (56) that engages the control lever (50), wherein the restoring spring (56) tends to actuate the control lever (50) in a direction of lower power of the engine (12) toward a movable stop (60) into a position of repose.

13. An apparatus as defined by claim 9, in which the control lever (50) is actuatable via the servo motor (52) in a direction of higher power of the engine (12), wherein upon decreasing driving force of the servo motor (52), the control lever (50) is actuated by spring force in a direction of a position of repose.

14. An apparatus as defined by claim 10, in which the control lever (50) is actuatable via the servo motor (52) in a direction of higher power of the engine (12), wherein upon decreasing driving force of the servo motor (52), the control lever (50) is actuated by spring force in a direction of a position of repose.

15. An apparatus as defined by claim 11, in which the control lever (50) is actuatable via the servo motor (52) in a direction of higher power of the engine (12), wherein upon decreasing driving force of the servo motor (52), the control lever (50) is actuated by spring force in a direction of a position of repose.

16. An apparatus as defined by claim 12, in which the control lever (50) is actuatable via the servo motor (52) in a direction of higher power of the engine (12), wherein upon decreasing driving force of the servo motor (52), the control lever (50) is actuated by spring force in a direction of a position of repose.

17. An apparatus as defined by claim 9, in which the movable stop (60) is adjustable, via the control lever (50) driven by the servo motor (52), counter to a prestressed spring (72) past a position of repose in a direction of lower power of the engine (12).

18. An apparatus as defined by claim 17, in which with decreasing driving force the prestressed spring (72) can actuate the control lever (50) past the movable stop (60) in the direction of higher power of the engine (12) until attainment of a position of repose.

19. An apparatus as defined by claim 1, in which a spacing (16, 20, 28) is provided between the positioner (6) and the operating element (2), so that the positioner (6) is actuatable by the operating element (2) only in a direction of higher power of the engine (12).

20. An apparatus as defined by claim 2, in which a spacing (16, 20, 28) is provided between the positioner (6) and the operating element (2), so that the positioner (6) is actuatable by the operating element (2) only in a direction of higher power of the engine (12).

21. An apparatus as defined by claim 5, in which a spacing (16, 20, 28) is provided between the positioner (6) and the operating element (2), so that the positioner (6) is actuatable by the operating element (2) only in a direction of higher power of the engine (12).

22. An apparatus as defined by claim 9, in which a spacing (16, 20, 28) is provided between the positioner (6) and the operating element (2), so that the positioner (6) is actuatable by the operating element (2) only in a direction of higher power of the engine (12).

23. An apparatus as defined by claim 13, in which a spacing (16, 20, 28) is provided between the positioner (6) and the operating element (2), so that the positioner (6) is actuatable by the operating element (2) only in a direction of higher power of the engine (12).

24. An apparatus as defined by claim 17, in which a spacing (16, 20, 28) is provided between the positioner (6) and the operating element (2), so that the positioner (6) is actuatable by the operating element (2) only in a direction of higher power of the engine (12).

25. An apparatus as defined by claim 18, in which a spacing (16, 20, 28) is provided between the positioner (6) and the operating element (2), so that the positioner (6) is actuatable by the operating element (2) only in a direction of higher power of the engine (12).

* * * * *